US007457742B2

(12) United States Patent
Kovesi et al.

(10) Patent No.: US 7,457,742 B2
(45) Date of Patent: Nov. 25, 2008

(54) VARIABLE RATE AUDIO ENCODER VIA SCALABLE CODING AND ENHANCEMENT LAYERS AND APPERTAINING METHOD

(75) Inventors: Balazs Kovesi, Lannion (FR); Dominique Massaloux, Perros-Guirec (FR)

(73) Assignee: France Telecom, Paris (FR)

( * ) Notice: Subject to any disclaimer, the term of this patent is extended or adjusted under 35 U.S.C. 154(b) by 550 days.

(21) Appl. No.: 10/541,340

(22) PCT Filed: Dec. 22, 2003

(86) PCT No.: PCT/FR03/03870

§ 371 (c)(1),
(2), (4) Date: Jul. 1, 2005

(87) PCT Pub. No.: WO2004/070706

PCT Pub. Date: Aug. 19, 2004

(65) Prior Publication Data

US 2006/0036435 A1 Feb. 16, 2006

(30) Foreign Application Priority Data

Jan. 8, 2003 (FR) ..... 03 00164

(51) Int. Cl.
*G10L 19/00* (2006.01)
*G10L 21/00* (2006.01)

(52) U.S. Cl. ..... 704/201; 704/200; 704/200.1; 704/500; 704/501

(58) Field of Classification Search ..... 704/229, 704/200.1, 211, 200, 201, 500, 501
See application file for complete search history.

(56) References Cited

U.S. PATENT DOCUMENTS 4,949,383 A * 8/1990 Koh et al. ..... 704/229

(Continued)

OTHER PUBLICATIONS

Erdmann et al., "A Candidate Proposal for a 3GPP Adaptive Multi-Rate Wideband Speech Codec," International Conference on Acoustics, Speech and Signal Processing, ICASSP'01, May 7-11, 2001, vol. 2, pp. 757-760, Salt Lake City (May 7-11, 2001).

(Continued)

*Primary Examiner*—Talivaldis Ivars Smits
*Assistant Examiner*—Douglas C Godbold
(74) *Attorney, Agent, or Firm*—Drinker Biddle & Reath LLP

(57) ABSTRACT

A maximum of Nmax bits for encoding is defined for a set of parameters which may be calculated from a signal frame. The parameters for a first sub-set are calculated and encoded with N0 bits, where N0<Nmax. The allocation of Nmax−N0 encoding bits for the parameters of a second sub-set are determined and the encoding bits allocated to the parameters for the second sub-set are classified. The allocation and/or order of classification of the encoding bits are determined as a function of the encoding parameters for the first sub-set. For a total of N available bits for the encoding of the total parameters (N0<N=Nmax), the parameters for the second sub-set allocated the N−N0 encoding bits classified the first in said order are selected. Said selected parameters are calculated and encoded to give the N−N0 bits. The N0 encoding bits for the first sub-set and the N−N0 encoding bits for the selected parameters for the second sub-set are finally introduced into the output sequence of the encoder.

38 Claims, 3 Drawing Sheets

U.S. PATENT DOCUMENTS

| | | | | |
|---|---|---|---|---|
| 6,016,111 | A * | 1/2000 | Park et al. | 341/55 |
| 6,370,507 | B1 * | 4/2002 | Grill et al. | 704/500 |
| 2004/0010407 | A1 | 1/2004 | Kovesi et al. | |
| 2005/0010395 | A1 * | 1/2005 | Chiu et al. | 704/200.1 |

OTHER PUBLICATIONS

Shen et al., "A Progressive Algorithm for Perceptual Coding of Digital Audio Signals," Signals, Systems, and Computers, 1999, Conference Record of the Thirty-Third Asilomar Conference on Oct. 24-27, 1999, pp. 1105-1109, IEEE, Piscataway, NJ, USA (Oct. 24, 1999).

3rd Generation Partnership Project, "Wide Band Adaptive Multirate," 3GPP TS 26.190, V5.1.0, Technical Specification (Dec. 2001).

3rd Generation Partnership Project, "Narrow Band Adaptive Multirate," 3GPP TS 26.090, V5.0.0., Technical Specification (Jun. 2001).

* cited by examiner

VARIABLE RATE AUDIO ENCODER VIA SCALABLE CODING AND ENHANCEMENT LAYERS AND APPERTAINING METHOD

CROSS-REFERENCE TO RELATED APPLICATIONS

This application is the U.S. national phase of the PCT/FR2003/003870 filed Dec. 22, 2003, which claims the benefit of French Application No. 03 00164 filed Jan. 8, 2003, the entire content of which is incorporated herein by reference.

BACKGROUND OF THE INVENTION

The invention relates to devices for coding and decoding audio signals, intended in particular to sit within applications of transmission or storage of digitized and compressed audio signals (speech and/or sounds).

More particularly, this invention pertains to audio coding systems having the capacity to provide varied bit rates, also referred to as multirate coding systems. Such systems are distinguished from fixed rate coders by their capacity to modify the bit rate of the coding, possibly during processing, this being especially suited to transmission over heterogeneous access networks: be they networks of IP type mixing fixed and mobile access, high bit rates (ADLS), low bit rates (RTC, GPRS modems) or involving terminals with variable capacities (mobiles, PCs, etc.).

Essentially, two categories of multirate coders are distinguished: that of "switchable" multirate coders and that of "hierarchical" coders.

"Switchable" multirate coders rely on a coding architecture belonging to a technological family (temporal coding or frequency coding, for example: CELP, sinusoidal, or by transform), in which an indication of bit rate is simultaneously supplied to the coder and to the decoder. The coder uses this information to select the parts of the algorithm and the tables relevant to the bit rate chosen. The decoder operates in a symmetric manner. Numerous switchable multirate coding structures have been proposed for audio coding. Such is the case for example with mobile coders standardized by the 3GPP organization ("3rd Generation Partnership Project"), NB-AMR ("Narrow Band Adaptive Multirate", Technical Specification 3GPP TS 26.090, version 5.0.0, June 2002) in the telephone band, or WB-AMR ("Wide Band Adaptive Multirate", Technical Specification 3GPP TS 26.190, version 5.1.0, December 2001) in wideband. These coders operate over fairly wide bit rate ranges (4.75 to 12.2 kbit/s for NB-AMR, and 6.60 to 23.85 kbit/s for WB-AMR), with a fairly sizeable granularity (8 bit rates for NB-AMR and 9 for WB-AMR) . However, the price to be paid for this flexibility is a rather considerable complexity of structure: to be able to host all these bit rates, these coders must support numerous different options, varied quantization tables etc. The performance curve increases progressively with bit rate, but the progress is not linear and certain bit rates are in essence better optimized than others.

In so-called "hierarchical" coding systems, also referred to as "scalable", the binary data arising from the coding operation are distributed into successive layers. A base layer, also called the "kernel", is formed of the binary elements that are absolutely necessary for the decoding of the binary train, and determine a minimum quality of decoding.

The subsequent layers make it possible to progressively improve the quality of the signal arising from the decoding operation, each new layer bringing new information which, utilized by the decoder, supplies a signal of increasing quality at output.

One of the particular features of hierarchical coding is the possibility offered of intervening at any level whatsoever of the transmission or storage chain so as to delete a part of the binary train without having to supply any particular indication to the coder or to the decoder. The decoder uses the binary information that it receives and produces a signal of corresponding quality.

The field of hierarchical coding structures has given rise likewise to much work. Certain hierarchical coding structures operate on the basis of one type of coder alone, designed to deliver hierarchized coded information. When the additional layers improve the quality of the output signal without modifying the bandwidth, one speaks rather of "embedded coders" (see for example R. D. Lacovo et al., "Embedded CELP Coding for Variable Bit-Rate Between 6.4 and 9.6 kbit/s, Proc. ICASSP 1991, pp. 681-686). Coders of this type do not however allow large gaps between the lowest and the highest bit rate proposed.

The hierarchy is often used to progressively increase the bandwidth of the signal: the kernel supplies a baseband signal, for example telephonic (300-3400 Hz), and the subsequent layers allow the coding of additional frequency bands (for example, wide band up to 7 kHz, HiFi band up to 20 kHz or intermediate, etc.). The subband coders or coders using a time/frequency transformation such as described in the documents "Subband/transform coding using filter banks designs based on time domain aliasing cancellation" by J. P. Princen et al. (Proc. IEEE ICASSP-87, pp. 2161-2164) and "High Quality Audio Transform Coding at 64 kbit/s", by Y. Mahieux et al. (IEEE Trans. Commun., Vol. 42, No. 11, November 1994, pp. 3010-3019), lend themselves particularly to such operations.

Moreover, a different coding technique is frequently used for the kernel and for the module or modules coding the additional layers, one then speaks of various coding stages, each stage consisting of a subcoder. The subcoder of the stage of a given level will be able either to code parts of the signal that are not coded by the previous stages, or to code the coding residual of the previous stage, the residual is obtained by subtracting the decoded signal from the original signal.

The advantage of such structures it that they make it possible to go down to relatively low bit rates with sufficient quality, while producing good quality at high bit rate. Specifically, the techniques used for low bit rates are not generally effective at high bit rates and vice versa.

Such structures making it possible to use two different technologies (for example CELP and time/frequency transform, etc.) are especially effective for sweeping large bit rate ranges.

However, the hierarchical coding structures proposed in the prior art define precisely the bit rate allocated to each of the intermediate layers. Each layer corresponds to the encoding of certain parameters, and the granularity of the hierarchical binary train depends on the bit rate allocated to these parameters (typically a layer can contain of the order of a few tens of bits per frame, a signal frame consisting of a certain number of samples of the signal over a given duration, the example described later considering a frame of 960 samples corresponding to 60 ms of signal).

Moreover, when the bandwidth of the decoded signals can vary according to the level of the layers of binary elements, the modification of the line bit rate may produce artifacts that impede listening.

SUMMARY OF THE INVENTION

The present invention has the aim in particular of proposing a multirate coding solution which alleviates the drawbacks cited in the case of the use of existing hierarchical and switchable codings.

The invention thus proposes a method of coding a digital audio signal frame as a binary output sequence, in which a maximum number Nmax of coding bits is defined for a set of parameters that can be calculated according to the signal frame, which set is composed of a first and of a second subset. The proposed method comprises the following steps:

- calculating the parameters of the first subset, and coding these parameters on a number N0 of coding bits such that N0<Nmax;
- determining an allocation of Nmax−N0 coding bits for the parameters of the second subset; and
- ranking the Nmax−N0 coding bits allocated to the parameters of the second subset in a determined order.

The allocation and/or the order of ranking of the Nmax−N0 coding bits are determined as a function of the coded parameters of the first subset. The coding method furthermore comprises the following steps in response to the indication of a number N of bits of the binary output sequence that are available for the coding of said set of parameters, with N0<N≦Nmax:

- selecting the second subset's parameters to which are allocated the N−N0 coding bits ranked first in said order;
- calculating the selected parameters of the second subset, and coding these parameters so as to produce said N−N0 coding bits ranked first; and
- inserting into the output sequence the N0 coding bits of the first subset as well as the N−N0 coding bits of the selected parameters of the second subset.

The method according to the invention makes it possible to define a multirate coding, which will operate at least in a range corresponding for each frame to a number of bits ranging from N0 to Nmax.

It may thus be considered that the notion of pre-established bit rates which is related to the existing hierarchical and switchable codings is replaced by a notion of "cursor", making it possible to freely vary the bit rate between a minimum value (that may possibly correspond to a number of bits N less than N0) and a maximum value (corresponding to Nmax). These extreme values are potentially far apart. The method offers good performance in terms of effectiveness of coding regardless of the bit rate chosen.

Advantageously, the number N of bits of the binary output sequence is strictly less than Nmax. What is noteworthy about the coder is then that the allocation of the bits that is employed makes no reference to the actual output bit rate of the coder, but to another number Nmax agreed with the decoder.

It is however possible to fix Nmax=N as a function of the instantaneous bit rate available on a transmission channel. The output sequence of a switchable multirate coder such as this may be processed by a decoder which does not receive the entire sequence, so long as it is capable of retrieving the structure of the coding bits of the second subset by virtue of the knowledge of Nmax.

Another case where it is possible to have N=Nmax is that of the storage of audio data at the maximum coding rate. When reading N' bits of this content stored at lower bit rate, the decoder would be capable of retrieving the structure of the coding bits of the second subset as long as N'≧N0.

The order of ranking of the coding bits allocated to the parameters of the second subset may be a preestablished order.

In a preferred embodiment, the order of ranking of the coding bits allocated to the parameters of the second subset is variable. It may in particular be an order of decreasing importance determined as a function of at least the coded parameters of the first subset. Thus the decoder which receives a binary sequence of N' bits for the frame, with N0≦N'≦N≦Nmax, will be able to deduce this order from the N0 bits received for the coding of the first subset.

The allocation of the Nmax−N0 bits to the coding of the parameters of the second subset may be carried out in a fixed manner (in this case, the order of ranking of these bits will be dependent at least on the coded parameters of the first subset).

In a preferred embodiment, the allocation of the Nmax−N0 bits to the coding of the parameters of the second subset is a function of the coded parameters of the first subset.

Advantageously, this order of ranking of the coding bits allocated to the parameters of the second subset is determined with the aid of at least one psychoacoustic criterion as a function of the coded parameters of the first subset.

The parameters of the second subset pertain to spectral bands of the signal. In this case, the method advantageously comprises a step of estimating a spectral envelope of the coded signal on the basis of the coded parameters of the first subset, and a step of calculating a curve of frequency masking by applying an auditory perception model to the estimated spectral envelope, and the psychoacoustic criterion makes reference to the level of the estimated spectral envelope with respect to the masking curve in each spectral band.

In a mode of implementation, the coding bits are ordered in the output sequence in such a way that the N0 coding bits of the first subset precede the N−N0 coding bits of the selected parameters of the second subset and that the respective coding bits of the selected parameters of the second subset appear therein in the order determined for said coding bits. This makes it possible, in the case where the binary sequence is truncated, to receive the most important part.

The number N may vary from one frame to another, in particular as a function for example of the available capacity of the transmission resource.

The multirate audio coding according to the present invention may be used according to a very flexible hierarchical or switchable mode, since any number of bits to be transmitted chosen freely between N0 and Nmax may be selected at any moment, that is to say frame by frame.

The coding of the parameters of the first subset may be at variable bit rate, thereby varying the number N0 from one frame to another. This allows best adjustment of the distribution of the bits as a function of the frames to be coded.

In a mode of implementation, the first subset comprises parameters calculated by a coder kernel. Advantageously, the coder kernel has a lower frequency band of operation than the bandwidth of the signal to be coded, and the first subset furthermore comprises energy levels of the audio signal that are associated with frequency bands higher than the operating band of the coder kernel. This type of structure is that of a hierarchical coder with two levels, which delivers for example via the coder kernel a coded signal of a quality deemed to be sufficient and which, as a function of the bit rate available, supplements the coding performed by the coder kernel with additional information arising from the method of coding according to the invention.

Preferably, the coding bits of the first subset are then ordered in the output sequence in such a way that the coding bits of the parameters calculated by the coder kernel are immediately followed by the coding bits of the energy levels associated with the higher frequency bands. This ensures one and the same bandwidth for the successively coded frames as long as the decoder receives enough bits to be in possession of information of the coder kernel and coded energy levels associated with the higher frequency bands.

In a mode of implementation, a signal of difference between the signal to be coded and a synthesis signal derived from the coded parameters produced by the coder kernel is estimated, and the first subset furthermore comprises energy levels of the difference signal that are associated with frequency bands included in the operating band of the coder kernel.

A second aspect of the invention pertains to a method of decoding a binary input sequence so as to synthesize a digital audio signal corresponding to the decoding of a frame coded according to the method of coding of the invention. According to this method, a maximum number Nmax of coding bits is defined for a set of parameters for describing a signal frame, which set is composed of a first and a second subset. The input sequence comprises, for a signal frame, a number N' of coding bits for the set of parameters, with $N' \leqq Nmax$. The decoding method according to the invention comprises the following steps:

- extracting, from said N' bits of the input sequence, a number N0 of coding bits of the parameters of the first subset if $N0<N'$;
- recovering the parameters of the first subset on the basis of said N0 coding bits extracted;
- determining an allocation of Nmax−N0 coding bits for the parameters of the second subset; and
- ranking the Nmax−N0 coding bits allocated to the parameters of the second subset in a determined order.

The allocation and/or the order of ranking of the Nmax−N0 coding bits are determined as a function of the recovered parameters of the first subset. The decoding method furthermore comprises the following steps:

- selecting the second subset's parameters to which are allocated the N'−N0 coding bits ranked first in said order;
- extracting, from said N' bits of the input sequence, N'−N0 coding bits of the selected parameters of the second subset;
- recovering the selected parameters of the second subset on the basis of said N'−N0 coding bits extracted; and
- synthesizing the signal frame by using the recovered parameters of the first and second subsets.

This method of decoding is advantageously associated with procedures for regenerating the parameters which are missing on account of the truncation of the sequence of Nmax bits that is produced, virtually or otherwise, by the coder.

A third aspect of the invention pertains to an audio coder, comprising means of digital signal processing that are devised to implement a method of coding according to the invention.

Another aspect of the invention pertains to an audio decoder, comprising means of digital signal processing that are devised to implement a method of decoding according to the invention.

DESCRIPTION OF PREFERRED EMBODIMENTS

Figure 1:
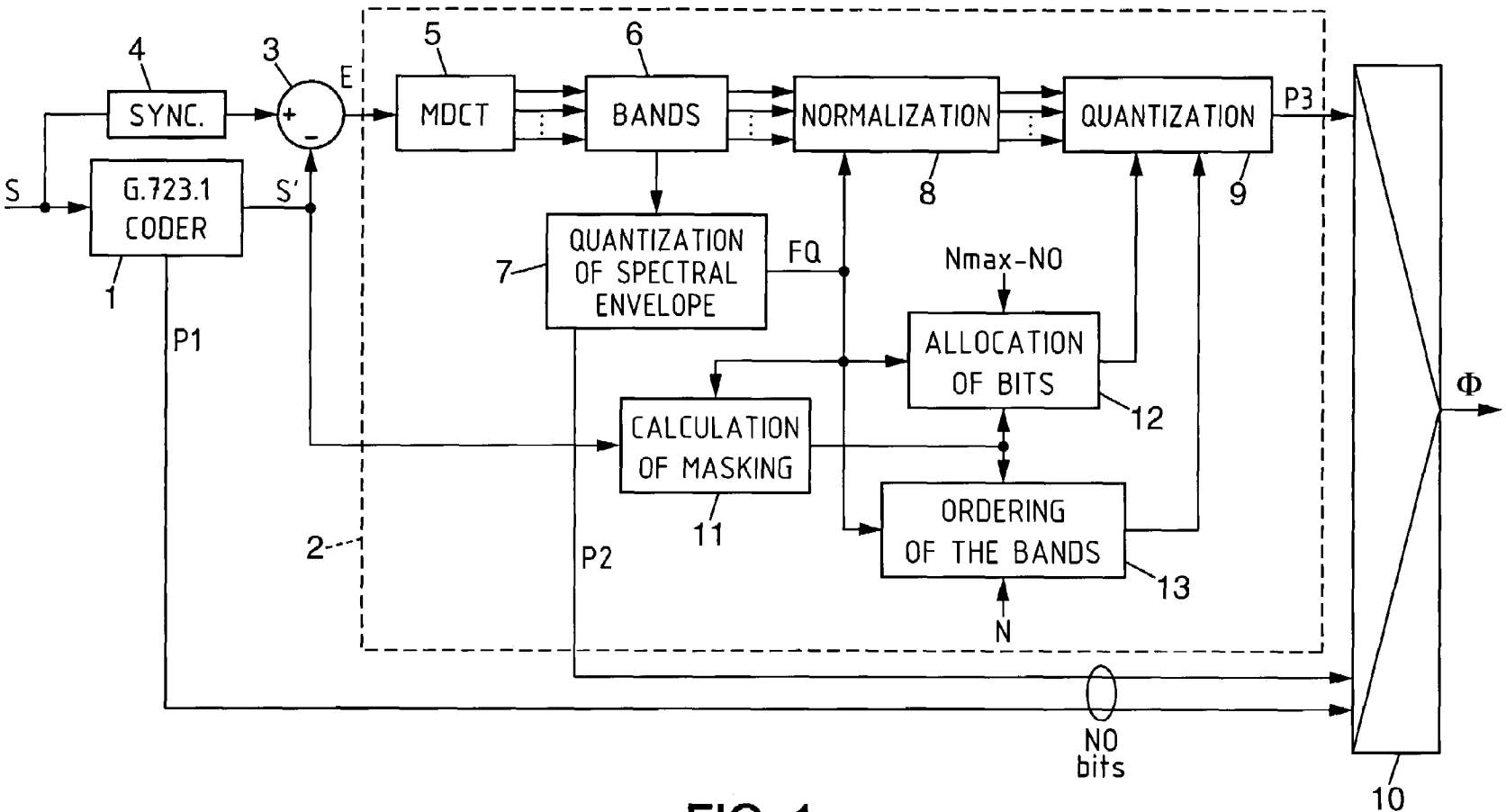
FIG. 1 is a schematic diagram of an exemplary audio coder according to the invention.

The coder represented in FIG. 1 has a hierarchical structure with two coding stages. A first coding stage 1 consists for example of a coder kernel in a telephone band (300-3400 Hz) of CELP type. This coder is in the example considered a G.723.1 coder standardized by the ITU-T ("International Telecommunication Union") in fixed mode at 6.4 kbit/s. It calculates G.723.1 parameters in accordance with the standard and quantizes them by means of 192 coding bits P1 per frame of 30 ms.

The second coding stage 2, making it possible to increase the bandwidth towards the wide band (50-7000 Hz), operates on the coding residual E of the first stage, supplied by a subtractor 3 in the diagram of FIG. 1. A signals synchronization module 4 delays the audio signal frame S by the time taken by the processing of the coder kernel 1. Its output is addressed to the subtractor 3 which subtracts from it the synthetic signal S' equal to the output of the decoder kernel operating on the basis of the quantized parameters such as represented by the output bits P1 of the coder kernel. As is usual, the coder 1 incorporates a local decoder supplying S'.

The audio signal to be coded S has for example a bandwidth of 7 kHz, while being sampled at 16 kHz. A frame consists for example of 960 samples, i.e. 60 ms of signal or two elementary frames of the coder kernel G.723.1. Since the latter operates on signals sampled at 8 kHz, the signal S is subsampled in a factor 2 at the input of the coder kernel 1. Likewise, the synthetic signal S' is oversampled at 16 kHz at the output of the coder kernel 1.

The bit rate of the first stage 1 is 6.4 kbit/s ($2\times N1=2\times 192=384$ bits per frame). If the coder has a maximum bit rate of 32 kbit/s (Nmax=1920 bits per frame), the maximum bit rate of the second stage is 25.6 kbit/s (1920−384=1536 bits per frame). The second stage 2 operates for example on elementary frames, or subframes, of 20 ms (320 samples at 16 kHz).

The second stage 2 comprises a time/frequency transformation module 5, for example of MDCT ("Modified Discrete Cosine Transform") type to which the residual E obtained by the subtractor 3 is addressed. In practice, the manner of operation of the modules 3 and 5 represented in FIG. 1 may be achieved by performing the following operations for each 20 ms subframe:

- MDCT transformation of the input signal S delayed by the module 4, which supplies 320 MDCT coefficients. The spectrum being limited to 7225 Hz, only the first 289 MDCT coefficients are different from 0;
- MDCT transformation of the synthetic signal S'. Since one is dealing with the spectrum of a telephone band signal, only the first 139 MDCT coefficients are different from 0 (up to 3450 Hz); and
- calculation of the spectrum of difference between the previous spectra.

The resulting spectrum is distributed into several bands of different widths by a module 6. By way of example, the bandwidth of the G.723.1 codec may be subdivided into 21 bands while the higher frequencies are distributed into 11 additional bands. In these 11 additional bands, the residual E is identical to the input signal S.

A module 7 performs the coding of the spectral envelope of the residual E. It begins by calculating the energy of the MDCT coefficients of each band of the difference spectrum. These energies are hereinbelow referred to as "scale factors". The 32 scale factors constitute the spectral envelope of the difference signal. The module 7 then proceeds to their quantization in two parts. The first part corresponds to the telephone band (first 21 bands, from 0 to 3450 Hz), the second to the high bands (last 11 bands, from 3450 to 7225 Hz) . In each part, the first scale factor is quantized on an absolute basis, and the subsequent ones on a differential basis, by using a conventional Huffman coding with variable bit rate. These 32 scale factors are quantized on a variable number N2(i) of bits P2 for each subframe of rank i (i=1, 2, 3).

The quantized scale factors are denoted FQ in FIG. 1. The quantization bits P1, P2 of the first subset consisting of the quantized parameters of the coder kernel 1 and the quantized scale factors FQ are variable in number N0=(2×N1)+N2(1)+N2(2)+N2(3). The difference Nmax−N0=1536−N2(1)−N2(2)−N2(3) is available to quantize the spectra of the bands more finely.

A module 8 normalizes the MDCT coefficients distributed into bands by the module 6, by dividing them by the quantized scale factors FQ respectively determined for these bands. The spectra thus normalized are supplied to the quantization module 9 which uses a vector quantization scheme of known type. The quantization bits arising from the module 9 are denoted P3 in FIG. 1.

An output multiplexer 10 gathers together the bits P1, P2 and P3 arising from the modules 1, 7 and 9 to form the binary output sequence Φ of the coder.

In accordance with the invention, the total number of bits N of the output sequence representing a current frame is not necessarily equal to Nmax. It may be less than the latter. However, the allocation of the quantization bits to the bands is performed on the basis of the number Nmax.

In the diagram of FIG. 1, this allocation is performed for each subframe by the module 12 on the basis of the number Nmax−N0, of the quantized scale factors FQ and of a spectral masking curve calculated by a module 11.

The manner of operation of the latter module 11 is as follows. It firstly determines an approximate value of the original spectral envelope of the signal S on the basis of that of the difference signal, such as quantized by the module 7, and of that which it determines with the same resolution for the synthetic signal S' resulting from the coder kernel. These last two envelopes are also determinable by a decoder which is provided only with the parameters of the aforesaid first subset. Thus the estimated spectral envelope of the signal S will also be available to the decoder. Thereafter, the module 11 calculates a spectral masking curve by applying, in a manner known per se, a model of band by band auditory perception to the original estimated spectral envelope. This curve 11 gives a masking level for each band considered.

The module 12 carries out a dynamic allocation of the Nmax−N0 remaining bits of the sequence Φ among the 3×32 bands of the three MDCT transformations of the difference signal. In the implementation of the invention set forth here, as a function of a criterion of psychoacoustic perceptual importance making reference to the level of the spectral envelope estimated with respect to the masking curve in each band, a bit rate proportional to this level is allocated to each band. Other ranking criteria would be useable.

Subsequent to this allocation of bits, the module 9 knows how many bits are to be considered for the quantization of each band in each subframe.

Nevertheless, if N<Nmax, these allocated bits will not necessarily all be used. An ordering of the bits representing the bands is performed by a module 13 as a function of a criterion of perceptual importance. The module 13 ranks the 3×32 bands in an order of decreasing importance which may be the decreasing order of the signal-to-mask ratios (ratio between the estimated spectral envelope and the masking curve in each band). This order is used for the construction of the binary sequence Φ in accordance with the invention.

As a function of the desired number N of bits in the sequence Φ for the coding of the current frame, the bands which are to be quantized by the module 9 are determined by selecting the bands ranked first by the module 13 and by keeping for each band selected a number of bits such as is determined by the module 12.

Then the MDCT coefficients of each band selected are quantized by the module 9, for example with the aid of a vector quantizer, in accordance with the allocated number of bits, so as to produce a total number of bits equal to N−N0.

Figure 2:
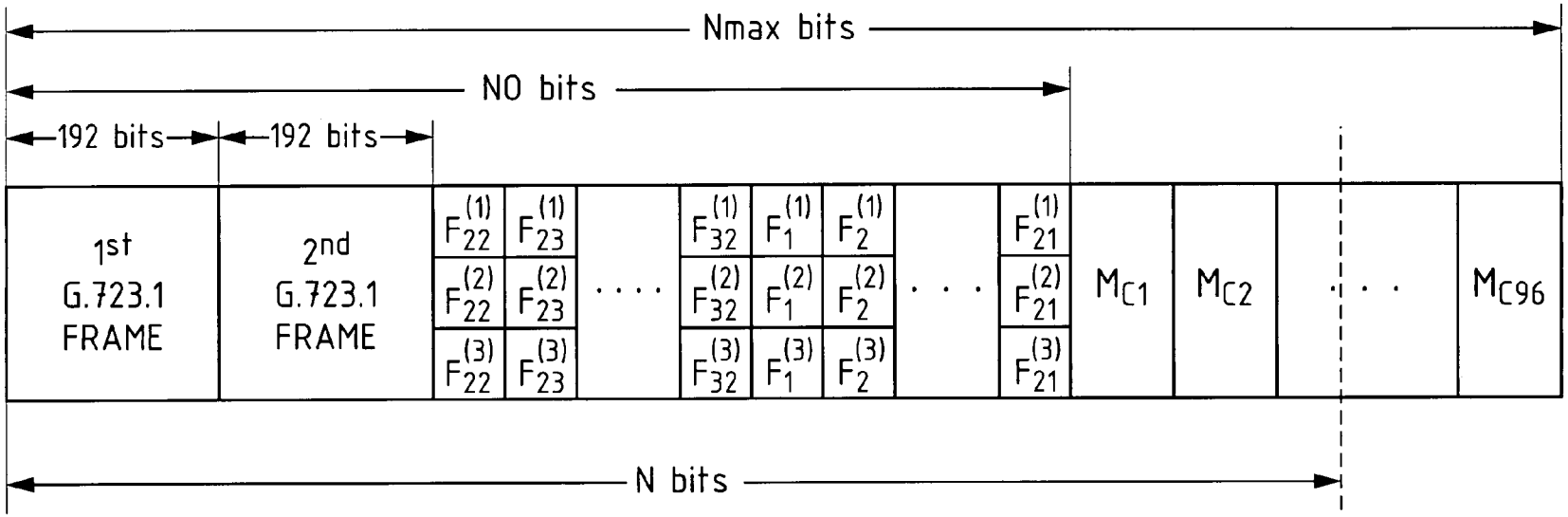
FIG. 2 represents a binary output sequence of N bits in an embodiment of the invention.

The output multiplexer 10 builds the binary sequence Φ consisting of the first N bits of the following ordered sequence represented in FIG. 2 (case N=Nmax):

a/ firstly the binary trains corresponding to the two G.723.1 frames (384 bits);

b/ next the bits $F_{22}^{(i)}, \ldots, F_{32}^{(i)}$ for quantizing the scale factors, for the three subframes (i=1, 2, 3), from the 22nd spectral band (first band beyond the telephone band) to the 32nd band (variable rate Huffman coding);

c/ next the bits $F_1^{(i)}, \ldots, F_{21}^{(i)}$ for quantizing the scale factors, for the three subframes (i=1, 2, 3), from the 1st spectral band to the 21st band (variable rate Huffman coding);

d/ and finally the indices $M_{c1}, M_{c2}, \ldots, M_{c96}$ of vector quantization of the 96 bands in order of perceptual importance, from the most important band to the least important band, while complying with the order determined by the module 13.

By placing first (a and b) the G.723.1 parameters and the scale factors of the high bands it is possible to retain the same bandwidth for the signal restorable by the decoder regardless of the actual bit rate beyond a minimum value corresponding to the reception of these groups a and b. This minimum value, sufficient for the Huffman coding of the 3×11=33 scale factors of the high bands in addition to the G.723.1 coding, is for example 8 kbit/s.

The method of coding hereinabove allows a decoding of the frame if the decoder receives N' bits with N0≦N'≦N. This number N' will generally be variable from one frame to another.

Figure 3:
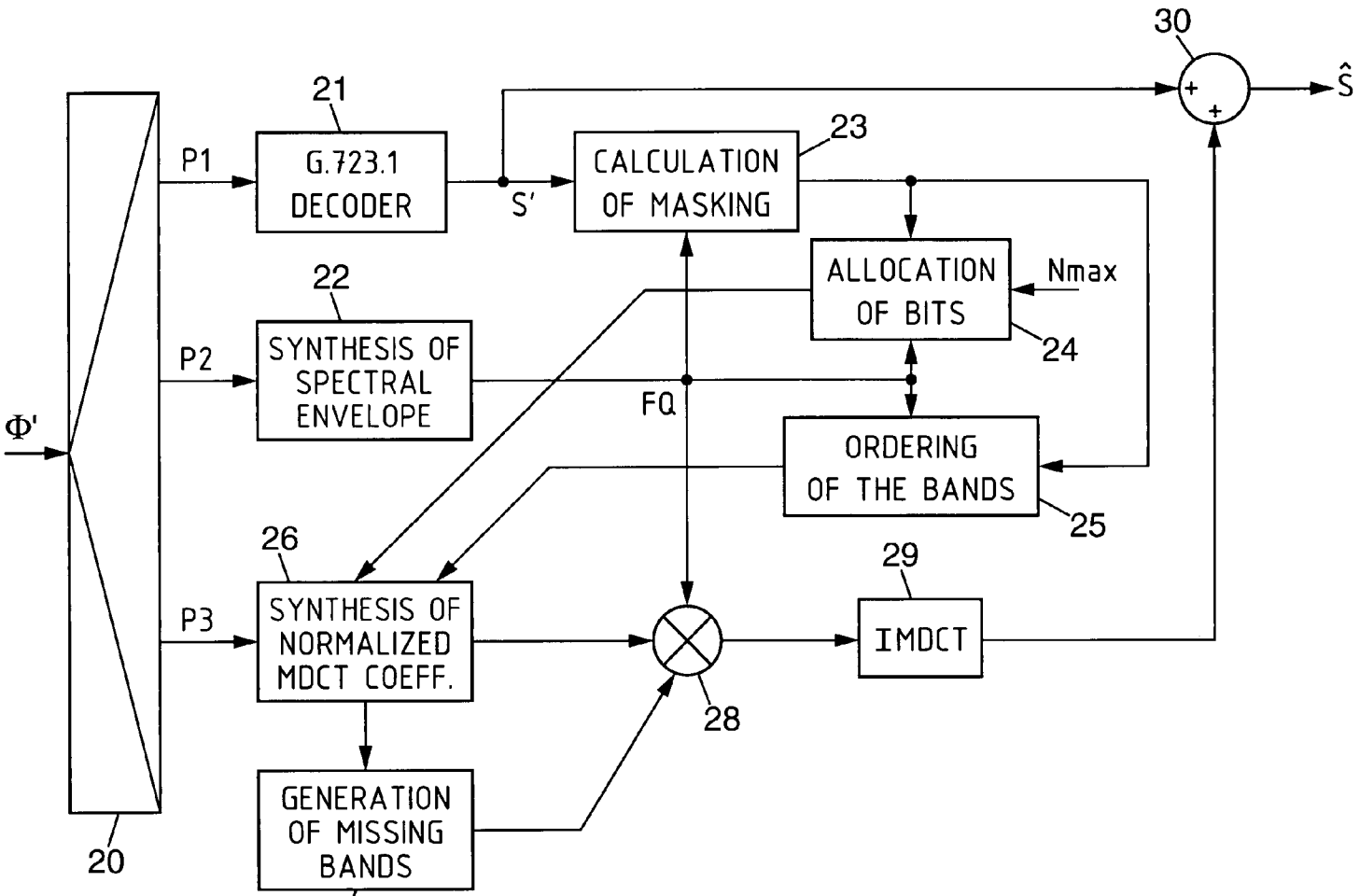
FIG. 3 is a schematic diagram of an audio decoder according to the invention.

A decoder according to the invention, corresponding to this example, is illustrated by FIG. 3. A demultiplexer 20 separates the sequence of bits received Φ' so as to extract therefrom the coding bits P1 and P2. The 384 bits P1 are supplied to the decoder kernel 21 of G.723.1 type so that the latter synthesizes two frames of the base signal S' in the telephone band. The bits P2 are decoded according to the Huffman algorithm by a module 22 which thus recovers the quantized scale factors FQ for each of the 3 subframes.

A module 23 calculating the masking curve, identical to the module 11 of the coder of FIG. 1, receives the base signal S' and the quantized scale factors FQ and produces the spectral masking levels for each of the 96 bands. On the basis of these masking levels, of the quantized scale factors FQ and of the knowledge of the number Nmax (as well as of that of the number N0 which is deduced from the Huffman decoding of the bits P2 by the module 22), a module 24 determines an allocation of bits in the same manner as the module 12 of FIG. 1. Furthermore, a module 25 proceeds to the ordering of the bands according to the same ranking criterion as the module 13 described with reference to FIG. 1.

According to the information supplied by the modules 24 and 25, the module 26 extracts the bits P3 of the input sequence Φ' and synthesizes the normalized MDCT coefficients relating to the bands represented in the sequence Φ'. If appropriate (N'<Nmax), the standardized MDCT coefficients relating to the missing bands may furthermore be synthesized by interpolation or extrapolation as described hereinbelow (module 27). These missing bands may have been eliminated by the coder on account of a truncation to N<Nmax, or they may have been eliminated in the course of transmission (N'<N).

The standardized MDCT coefficients, synthesized by the module 26 and/or the module 27, are multiplied by their respective quantized scale factors (multiplier 28) before being presented to the module 29 which performs the frequency/time transformation which is the inverse of the MDCT transformation operated by the module 5 of the coder. The temporal correction signal which results therefrom is added to the synthetic signal S' delivered by the decoder kernel 21 (adder 30) to produce the output audio signal $\hat{S}$ of the decoder.

It should be noted that the decoder will be able to synthesize a signal $\hat{S}$ even in cases where it does not receive the first N0 bits of the sequence.

It is sufficient for it to receive the 2×N1 bits corresponding to the part a of the listing hereinabove, the decoding then being in a "degraded" mode. Only this degraded mode does not use the MDCT synthesis to obtain the decoded signal. To ensure the switching with no break between this mode and the other modes, the decoder performs three MDCT analyses followed by three MDCT syntheses, allowing the updating of the memories of the MDCT transformation. The output signal contains a signal of telephone band quality. If the first 2×N1 bits are not even received, the decoder considers the corresponding frame as having been erased and can use a known algorithm for conceiving erased frames.

If the decoder receives the 2×N1 bits corresponding to part a plus bits of part b (high bands of the three spectral envelopes), it can begin to synthesize a wide band signal. It can in particular proceed as follows.

1/ The module 22 recovers the parts of the three spectral envelopes received.

2/ The bands not received have their scale factors temporarily set to zero.

3/ The low parts of the spectral envelopes are calculated on the basis of the MDCT analyses performed on the signal obtained after the G.723.1 decoding, and the module 23 calculates the three masking curves on the envelopes thus obtained.

4/ The spectral envelope is corrected so as to regularize it by avoiding the nulls due to the bands not received; the zero values in the high part of the spectral envelopes FQ are for example replaced by a hundredth of the value of the masking curve calculated previously, so that they remain inaudible. The complete spectrum of the low bands and the spectral envelope of the high bands are known at this juncture.

5/ The module 27 then generates the high spectrum. The fine structure of these bands is generated by reflection of the fine structure of its known neighborhood before weighting by the scale factors (multipliers 28). In the case where none of the bits P3 is received, the "known neighborhood" corresponds to the spectrum of the signal S' produced by the G.723.1 decoder kernel. Its "reflection" can consist in copying the value of the standardized MDCT spectrum, possibly with its variations being attenuated in proportion to the distance away from the "known neighborhood".

6/ After inverse MDCT transformation (29) and addition (30) of the resulting correction signal to the output signal of the decoder kernel, the wide band synthesized signal is obtained.

In the case where the decoder also receives part at least of the low spectral envelope of the difference signal (part c), it may or may not take this information into account to refine the spectral envelope in step 3.

If the decoder 10 receives enough bits P3 to decode at least the MDCT coefficients of the most important band, ranked first in the part d of the sequence, then the module 26 recovers certain of the normalized MDCT coefficients according to the allocation and ordering that are indicated by the modules 24 and 25. These MDCT coefficients therefore need not be interpolated as in step 5 hereinabove. For the other bands, the process of steps 1 to 6 is applicable by the module 27 in the same manner as previously, the knowledge of the MDCT coefficients received for certain bands allowing more reliable interpolation in step 5.

The bands not received may vary from one MDCT subframe to the next. The "known neighborhood" of a missing band may correspond to the same band in another subframe where it is not missing, and/or to one or more bands closest in the frequency domain in the course of the same subframe. It is also possible to regenerate an MDCT spectrum missing from a band for a subframe by calculating a weighted sum of contributions evaluated on the basis of several bands/subframes of the "known neighborhood".

Insofar as the actual bit rate of N' bits per frame places the last bit of a given frame arbitrarily, the last coded parameter transmitted may, according to case, be transmitted completely or partially. Two cases may then arise:

- either the coding structure adopted makes it possible to utilize the partial information received (case of scalar quantizers, or of vector quantization with partitioned dictionaries),
- or it does not allow it and the parameter not fully received is processed like the other parameters not received. It is noted that, for this latter case, if the order of the bits varies with each frame, the number of bits thus lost is variable and the selection of N' bits will produce on average, over the whole set of frames decoded, a better quality than that which would be obtained with a smaller number of bits.

The invention claimed is:

1. A method of coding a digital audio signal frame as a binary output sequence, in which a maximum number Nmax of coding bits is defined for a set of parameters that can be calculated according to the signal frame, which set is composed of a first and of a second subset, the method comprising the following steps:

calculating the parameters of the first subset, and coding these parameters on a number N0 of coding bits such that N0<Nmax;

determining an allocation of Nmax−N0 coding bits for the parameters of the second subset; and ranking the Nmax−N0 coding bits allocated to the parameters of the second subset in a determined order, in which at least one of the allocation and the order of ranking of the Nmax−N0 coding bits is determined as a function of the coded parameters of the first subset, the method furthermore comprising the following steps in response to the indication of a number N of bits of the binary output sequence that are available for the coding of said set of parameters, with N0<N≦Nmax:

selecting the second subset's parameters to which are allocated the N−N0 coding bits ranked first in said order;

calculating the selected parameters of the second subset, and coding these parameters so as to produce said N−N0 coding bits ranked first; and inserting into the output sequence the N0 coding bits of the first subset as well as the N−N0 coding bits of the selected parameters of the second subset.

2. The method as claimed in claim 1, in which the order of ranking of the coding bits allocated to the parameters of the second subset is variable from one frame to another.

3. The method as claimed in claim 1, in which N<Nmax.

4. The method as claimed in claim 1, in which the order of ranking of the coding bits allocated to the parameters of the second subset is an order of decreasing importance determined as a function of at least the coded parameters of the first subset.

5. The method as claimed in claim 4, in which the order of ranking of the coding bits allocated to the parameters of the second subset is determined with the aid of at least one psychoacoustic criterion as a function of the coded parameters of the first subset.

6. The method as claimed in claim 5, in which the parameters of the second subset pertain to spectral bands of the signal, in which a spectral envelope of the coded signal is estimated on the basis of the coded parameters of the first subset, in which a curve of frequency masking is calculated by applying an auditory perception model to the estimated spectral envelope, and in which the psychoacoustic criterion makes reference to the level of the estimated spectral envelope with respect to the masking curve in each spectral band.

7. The method as claimed in claim 4, in which Nmax=N.

8. The method as claimed in claim 1, in which the coding bits are ordered in the output sequence in such a way that the N0 coding bits of the first subset precede the N−N0 coding bits of the selected parameters of the second subset and that the respective coding bits of the selected parameters of the second subset appear therein in the order determined for said coding bits.

9. The method as claimed in claim 8, in which the coding bits of the first subset are ordered in the output sequence in such a way that the coding bits of the parameters calculated by the coder kernel are immediately followed by the coding bits of the energy levels associated with the higher frequency bands.

10. The method as claimed in claim 8, in which the coding bits of the first subset are ordered in the output sequence in such a way that the coding bits of the parameters calculated by the coder kernel are followed by the coding bits of the energy levels associated with the frequency band.

11. The method as claimed in claim 1, in which the number N varies from one frame to another.

12. The method as claimed in claim 1, in which the coding of the parameters of the first subset is at variable bit rate, thereby varying the number N0 from one frame to another.

13. The method as claimed in claim 1, in which the first subset comprises parameters calculated by a coder kernel.

14. The method as claimed in claim 13, in which the coder kernel has a lower frequency band of operation than the bandwidth of the signal to be coded, and in which the first subset furthermore comprises energy levels of the audio signal that are associated with frequency bands higher than the operating band of the coder kernel.

15. The method as claimed in claim 14, in which the coding bits of the first subset are ordered in the output sequence in such a way that the coding bits of the parameters calculated by the coder kernel are followed by the coding bits of the energy levels associated with the frequency band.

16. The method as claimed in claim 13, in which a signal of difference between the signal to be coded and a synthesis signal derived from the coded parameters produced by the coder kernel is estimated, and in which the first subset furthermore comprises energy levels of the difference signal that are associated with frequency bands included in the operating band of the coder kernel.

17. A method of decoding a binary input sequence so as to synthesize a digital audio signal, in which a maximum number Nmax of coding bits is defined for a set of parameters for describing a signal frame, which set is composed of a first and a second subset, the input sequence comprising, for a signal frame, a number N' of coding bits for said set of parameters, with N'≦Nmax the method comprising the following steps:

extracting, from said N' bits of the input sequence, a number N0 of coding bits of the parameters of the first subset if N0<N';

recovering the parameters of the first subset on the basis of said N0 coding bits extracted;

determining an allocation of Nmax−N0 coding bits for the parameters of the second subset; and ranking the Nmax−N0 coding bits allocated to the parameters of the second subset in a determined order, in which at least one of the allocation and the order of ranking of the Nmax−N0 coding bits is determined as a function of the recovered parameters of the first subset, the method furthermore comprising the following steps:

selecting the second subset's parameters to which are allocated the N'−N0 coding bits ranked first in said order;

extracting, from said N' bits of the input sequence, N'−N0 coding bits of the selected parameters of the second subset;

recovering the selected parameters of the second subset on the basis of said N'−N0 coding bits extracted; and synthesizing the signal frame by using the recovered parameters of the first and second subsets.

18. The method as claimed in claim 17, in which the order of ranking of the coding bits allocated to the parameters of the second subset is variable from one frame to another.

19. The method as claimed in claim 17, in which N'<Nmax.

20. The method as claimed in claim 17, in which the order of ranking of the coding bits allocated to the parameters of the second subset is an order of decreasing importance determined as a function of at least the recovered parameters of the first subset.

21. The method as claimed in claim 20, in which the order of ranking of the coding bits allocated to the parameters of the second subset is determined with the aid of at least one psychoacoustic criterion as a function of the recovered parameters of the first subset.

22. The method as claimed in claim 21, in which the parameters of the second subset pertain to spectral bands of the signal, in which a spectral envelope of the signal is estimated on the basis of the recovered parameters of the first subset, in which a curve of frequency masking is calculated by applying an auditory perception model to the estimated spectral envelope, and in which the psychoacoustic criterion makes reference to the level of the estimated spectral envelope with respect to the masking curve in each spectral band.

23. The method as claimed in claim 17, in which the N0 coding bits of the parameters of the first subset are extracted from the N' bits received at positions of the sequence which precede the positions from which are extracted the N'−N0 coding bits of the selected parameters of the second subset.

24. The method as claimed in claim 23, in which the coding bits of the first subset in the input sequence are ordered in such a way that the coding bits of the input parameters of the decoder kernel are immediately followed by the coding bits of the energy levels associated with the higher frequency bands.

25. The method as claimed in claim 24, comprising the following steps if the N' bits of the input sequence are limited to the coding bits of the input parameters of the decoder kernel and to part at least of the coding bits of the energy levels associated with the higher frequency bands:

extracting from the input sequence the coding bits of the input parameters of the decoder kernel and said part of the coding bits of the energy levels;

synthesizing a base signal in the decoder kernel and recovering energy levels associated with the higher frequency bands on the basis of said extracted coding bits;

calculating a spectrum of the base signal;

assigning an energy level to each higher band with which is associated an uncoded energy level in the input sequence;

synthesizing spectral components for each higher frequency band on the basis of the corresponding energy level and of the spectrum of the base signal in at least one band of said spectrum;

applying a transformation into the time domain to the synthesized spectral components so as to obtain a base signal correction signal; and adding together the base signal and the correction signal so as to synthesize the signal frame.

26. The method as claimed in claim 25, in which the energy level assigned to a higher band with which is associated an uncoded energy level in the input sequence is a fraction of a perceptual masking level calculated in accordance with the spectrum of the base signal and the energy levels recovered on the basis of the extracted coding bits.

27. The method as claimed in claim 23, in which the coding bits of the input parameters of the decoder kernel are extracted from the N' bits received at positions of the sequence which precede the positions from which are extracted the coding bits of the energy levels associated with the frequency bands.

28. The method as claimed in claim 17, in which, to synthesize the signal frame, nonselected parameters of the second subset are estimated by interpolation on the basis of at least selected parameters recovered on the basis of said N'−N0 coding bits extracted.

29. The method as claimed in claim 17, in which the first subset comprises input parameters of a decoder kernel.

30. The method as claimed in claim 29, in which the decoder kernel has a lower frequency band of operation than the bandwidth of the signal to be synthesized, and in which the first subset furthermore comprises energy levels of the audio signal that are associated with frequency bands higher than the operating band of the decoder kernel.

31. The method as claimed in claim 30, in which, for $N0<N'<Nmax$, unselected parameters of the second subset that pertain to spectral components in frequency bands are estimated with the aid of a calculated spectrum of the base signal and/or selected parameters recovered on the basis of said $N'<N0$ coding bits extracted.

32. The method as claimed in claim 31, in which the unselected parameters of the second subset in a frequency band are estimated with the aid of a spectral neighborhood of said band, which neighborhood is determined on the basis of the N' coding bits of the input sequence.

33. The method as claimed in claim 30, in which the coding bits of the input parameters of the decoder kernel are extracted from the N' bits received at positions of the sequence which precede the positions from which are extracted the coding bits of the energy levels associated with the frequency bands.

34. The method as claimed in claim 29, in which a base signal is synthesized in the decoder kernel, and in which the first subset furthermore comprises energy levels of a signal of difference between the signal to be synthesized and the base signal that are associated with frequency bands included in the operating band of the coder kernel.

35. The method as claimed in claim 17, in which the number N' varies from one frame to another.

36. The method as claimed in claim 17, in which the number N0 varies from one frame to another.

37. An audio coder, comprising:

means of digital signal processing that are devised to implement a method of coding a digital audio signal frame as a binary output sequence, in which a maximum number Nmax of coding bits is defined for a set of parameters that can be calculated according to the signal frame, which set is composed of a first and of a second subset, the method comprising the following steps:

calculating the parameters of the first subset, and coding these parameters on a number N0 of coding bits such that $N0<Nmax$;

determining an allocation of Nmax−N0 coding bits for the parameters of the second subset; and ranking the Nmax−N0 coding bits allocated to the parameters of the second subset in a determined order, in which at least one of the allocation and the order of ranking of the Nmax−N0 coding bits is determined as a function of the coded parameters of the first subset, the method furthermore comprising the following steps in response to the indication of a number N of bits of the binary output sequence that are available for the coding of said set of parameters, with $N0<N\leqq Nmax$:

selecting the second subset's parameters to which are allocated the N−N0 coding bits ranked first in said order;

calculating the selected parameters of the second subset, and coding these parameters so as to produce said N−N0 coding bits ranked first; and inserting into the output sequence the N0 coding bits of the first subset as well as the N−N0 coding bits of the selected parameters of the second subset.

38. An audio decoder, comprising means of digital signal processing that are devised to implement a method of decoding a binary input sequence so as to synthesize a digital audio signal, in which a maximum number Nmax of coding bits is defined for a set of parameters for describing a signal frame, which set is composed of a first and a second subset, the input sequence comprising, for a signal frame, a number N' of coding bits for said set of parameters, with $N'\leqq Nmax$, the method comprising the following steps:

extracting, from said N' bits of the input sequence, a number N0 of coding bits of the parameters of the first subset if $N0<N'$;

recovering the parameters of the first subset on the basis of said N0 coding bits extracted;

determining an allocation of Nmax−N0 coding bits for the parameters of the second subset; and ranking the Nmax−N0 coding bits allocated to the parameters of the second subset in a determined order, in which at least one of the allocation and the order of ranking of the Nmax−N0 coding bits is determined as a function of the recovered parameters of the first subset, the method furthermore comprising the following steps:

selecting the second subset's parameters to which are allocated the N'−N0 coding bits ranked first in said order;

extracting, from said N' bits of the input sequence, N'−N0 coding bits of the selected parameters of the second subset;

recovering the selected parameters of the second subset on the basis of said N'−N0 coding bits extracted; and synthesizing the signal frame by using the recovered parameters of the first and second subsets.

* * * * *

UNITED STATES PATENT AND TRADEMARK OFFICE

CERTIFICATE OF CORRECTION

PATENT NO. : 7,457,742 B2
APPLICATION NO. : 10/541340
DATED : November 25, 2008
INVENTOR(S) : Balazs Kovesi and Dominique Massaloux It is certified that error appears in the above-identified patent and that said Letters Patent is hereby corrected as shown below:

In Claim 31, Column 13, line 50, delete "N' < N0" and insert in its place --N' - N0--.

Signed and Sealed this

Eleventh Day of August, 2009

David J. Kappos

David J. Kappos
*Director of the United States Patent and Trademark Office*